US011692745B2

(12) United States Patent
Trenbath

(10) Patent No.: US 11,692,745 B2
(45) Date of Patent: Jul. 4, 2023

(54) METHOD AND APPARATUS FOR EXPELLING HEAT

(71) Applicant: Richard Stockton Trenbath, Houston, TX (US)

(72) Inventor: Richard Stockton Trenbath, Houston, TX (US)

(73) Assignee: Richard Stockton Trenbath, Houston, TX (US)

( * ) Notice: Subject to any disclaimer, the term of this patent is extended or adjusted under 35 U.S.C. 154(b) by 75 days.

(21) Appl. No.: 17/410,253

(22) Filed: Aug. 24, 2021

(65) Prior Publication Data

US 2022/0316771 A1 Oct. 6, 2022

Related U.S. Application Data

(60) Provisional application No. 63/169,341, filed on Apr. 1, 2021.

(51) Int. Cl.

| | |
|---|---|
| ***F25B 27/02*** | (2006.01) |
| ***F25B 41/20*** | (2021.01) |
| ***F25B 49/00*** | (2006.01) |
| ***F25B 30/06*** | (2006.01) |
| *F25B 39/04* | (2006.01) |
| *F25B 41/40* | (2021.01) |

(52) U.S. Cl.

CPC ..... *F25B 27/02* (2013.01); *F25B 30/06* (2013.01); *F25B 41/20* (2021.01); *F25B 49/00* (2013.01); *F25B 39/04* (2013.01); *F25B 41/40* (2021.01); *F25B 2700/19* (2013.01)

(58) Field of Classification Search

CPC ..... F25B 27/02; F25B 41/20; F25B 41/40; F25B 49/00; F25B 2700/19; F25B 39/04; F25B 2600/01; F25B 2600/027; F25B 2600/23; F25B 23/00; F25B 23/006; F25B 3/00; F28D 15/02; F28D 15/0208; F28D 15/06; F28D 11/00; F28D 11/02; F28D 11/025; F28D 11/04; F28D 11/06; F28D 11/08; F28F 5/00; F28F 5/02; F28F 5/04; F28F 5/06

See application file for complete search history.

(56) References Cited

U.S. PATENT DOCUMENTS 242,454 A 6/1881 Iske
243,909 A * 7/1881 Iske ..... F01K 27/005 60/675
250,821 A 12/1881 Landis
(Continued)

OTHER PUBLICATIONS

Wally Minto's Wonder Wheel, by E.F. Lindsley, published in Popular Science magazine, Mar. 1976.
(Continued)

*Primary Examiner* — David J Teitelbaum
*Assistant Examiner* — Devon Moore
(74) *Attorney, Agent, or Firm* — Squire Patton Boggs (US) LLP

(57) ABSTRACT

Methods and apparatuses for expelling heat may be provided. For example, an apparatus may comprise a rotating assembly, a support structure, a condenser water tank, and a control system. The apparatus may rotate the rotating assembly such that tanks of the assembly are rotated into and out of the condenser water tank. The rotation may be self-starting and controlled by a control system.

20 Claims, 11 Drawing Sheets

(56) References Cited

U.S. PATENT DOCUMENTS

| | | | | |
|---|---|---|---|---|
| 4,325,430 | A | 4/1982 | Husa | |
| 4,498,999 | A | 2/1985 | Ramet et al. | |
| 10,184,707 | B2 | 1/2019 | Jeong et al. | |
| 2011/0056225 | A1* | 3/2011 | Campbell | H05K 7/20381 62/223 |
| 2016/0377327 | A1* | 12/2016 | Adler | F28D 11/04 62/499 |

OTHER PUBLICATIONS

Robert Stirling, "The Stirling Engine of 1816," U.S. Pat. No. 4,081, date of patent: 1816, The Engineer, Dec. 14, 1917, p. 516—Part 1—The Economiser. http://hotairengines.org/closed-cycle-engine/stirling-1816.

* cited by examiner

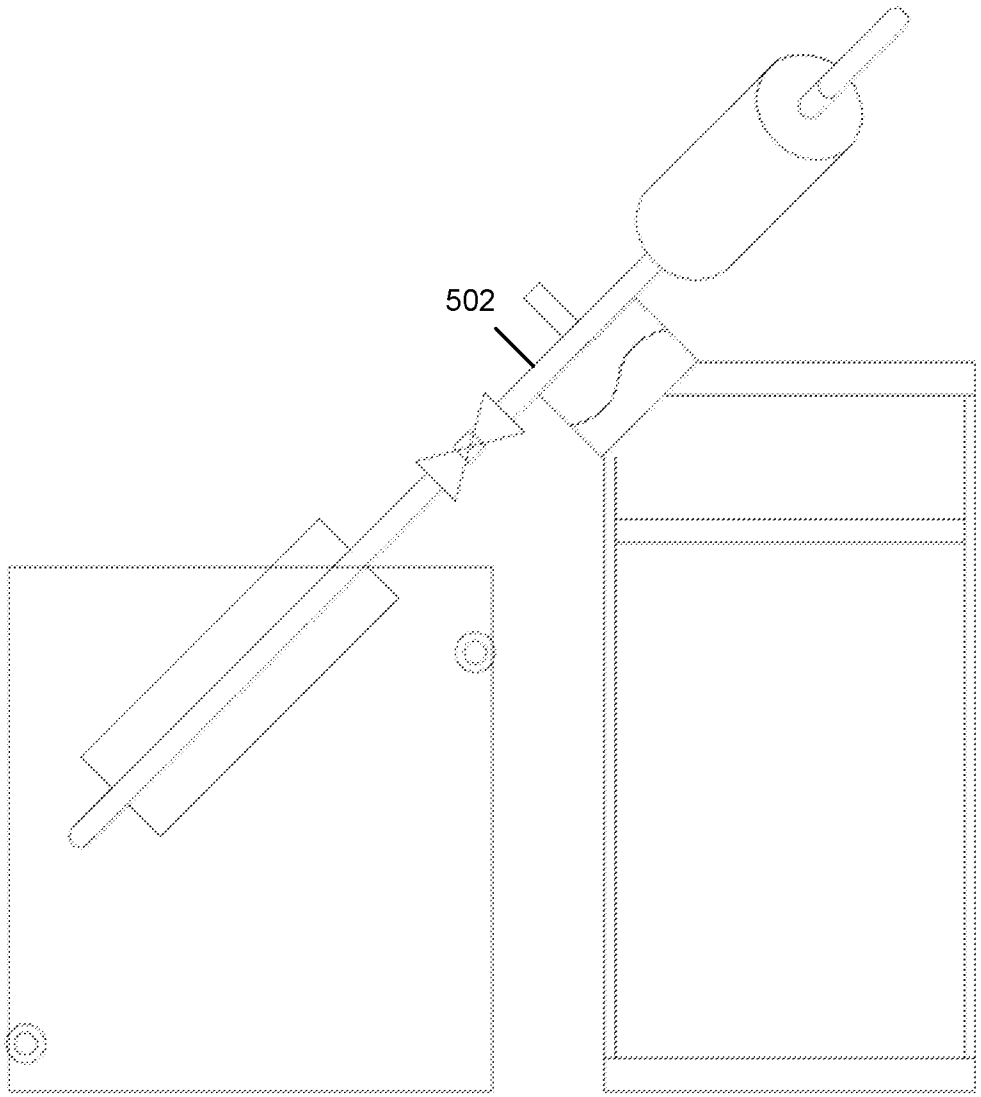
Fig. 5a
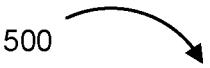

METHOD AND APPARATUS FOR EXPELLING HEAT

CROSS-REFERENCE TO RELATED APPLICATION

This application claims the benefit of U.S. Provisional Patent Application 63/169,341, filed Apr. 1, 2021, the contents of which is incorporated by reference herein in its entirety.

FIELD

Some example embodiments may generally relate to expelling waste heat from heat-generating processes, such as heating ventilation, and air conditioning (HVAC) systems. For example, certain embodiments may relate to systems, apparatuses, and/or methods for expelling heat.

BACKGROUND

The cost of utilizing electrical and mechanical power to expel waste heat from processes, such as HVAC processes is wasteful. Currently, cooling towers are utilized to transfer waste heat energy into the air utilizing electrically powered fans. The usage of waste heat can be accomplished with complex heat recovery chillers.

SUMMARY

In certain embodiments, the invention can include an apparatus, comprising a central shaft comprising a first end and a second end, and a plurality of arms each comprising a first end and a second end. The first end of each of the plurality of arms is connected to the first end of the central shaft. Each of the plurality of the arms extends radially about the first end of the central shaft perpendicular to the first end of the central shaft, and the plurality of the arms are spaced evenly about the first end of the central shaft. The plurality of arms comprises an odd number of arms and at least three arms. A plurality of vessels, each comprising a first end and a second end are provided, and the first end of the each of the plurality of the vessels is connected to the second end of a corresponding arm of the plurality of arms. A plurality of valves are disposed radially about the first end of the central shaft between adjacent vessels of the plurality of vessels. First piping connects each of the plurality of valves to the first end of one of the adjacent vessels, and second piping connects the each of the plurality of valves to the second end of another of the adjacent vessels; a plurality of taps are provided in the first piping and the second piping.

In certain embodiments, the invention can include an apparatus comprising a support structure comprising a first end and a second end; the first end is configured to mechanically support a central shaft of a rotary assembly; an open-topped tank is disposed at the second end of the support structure. The rotary assembly comprises a central shaft comprising a first end and a second end, and a plurality of arms each comprising a first end and a second end. The first end of each of the plurality of arms is connected to the first end of the central shaft, and each of the plurality of the arms extends radially about the first end of the central shaft perpendicular to the first end of the central shaft. The plurality of the arms are spaced evenly about the first end of the central shaft, and the plurality of arms comprises an odd number of arms and at least three arms. A plurality of vessels are provided, each comprising a first end and a second end.

The first end of the each of the plurality of the vessels is connected to the second end of a corresponding arm of the plurality of arms. A plurality of valves are disposed radially about the first end of the central shaft between adjacent vessels of the plurality of vessel, and first piping connects each of the plurality of valves to the first end of one of the adjacent vessels. Second piping connects the each of the plurality of valves to the second end of another of the adjacent vessels. A plurality of taps in the first piping and the second piping; the apparatus is configured to rotate the rotary assembly about an axis through the central shaft.

In certain embodiments, the invention can include a system, comprising a plurality of pressure transducers at a plurality of taps between adjacent vessels of a rotary assembly. The rotary assembly comprises an odd number of vessels and at least three vessels, and the vessels are attached to corresponding arms attached to a central shaft and extending radially from the central shaft. The arms are evenly distributed around the central shaft, and n the rotary assembly comprises first and second piping to connect adjacent vessels of the rotary assembly. Valve actuators are configured to actuate a plurality of valves of the rotary assembly associated with the plurality of taps. A rotational governor is configured to control rotation of the rotary assembly about an axis through the central shaft such that the vessels rotate through an open-topped tank as the rotary assembly is rotated.

BRIEF DESCRIPTION OF THE DRAWINGS

For proper understanding of example embodiments, reference should be made to the accompanying drawings, wherein:

FIG. 5*a* illustrate a side view of an example of another apparatus for expelling heat, according to some embodiments;

DETAILED DESCRIPTION

Figure 1A:
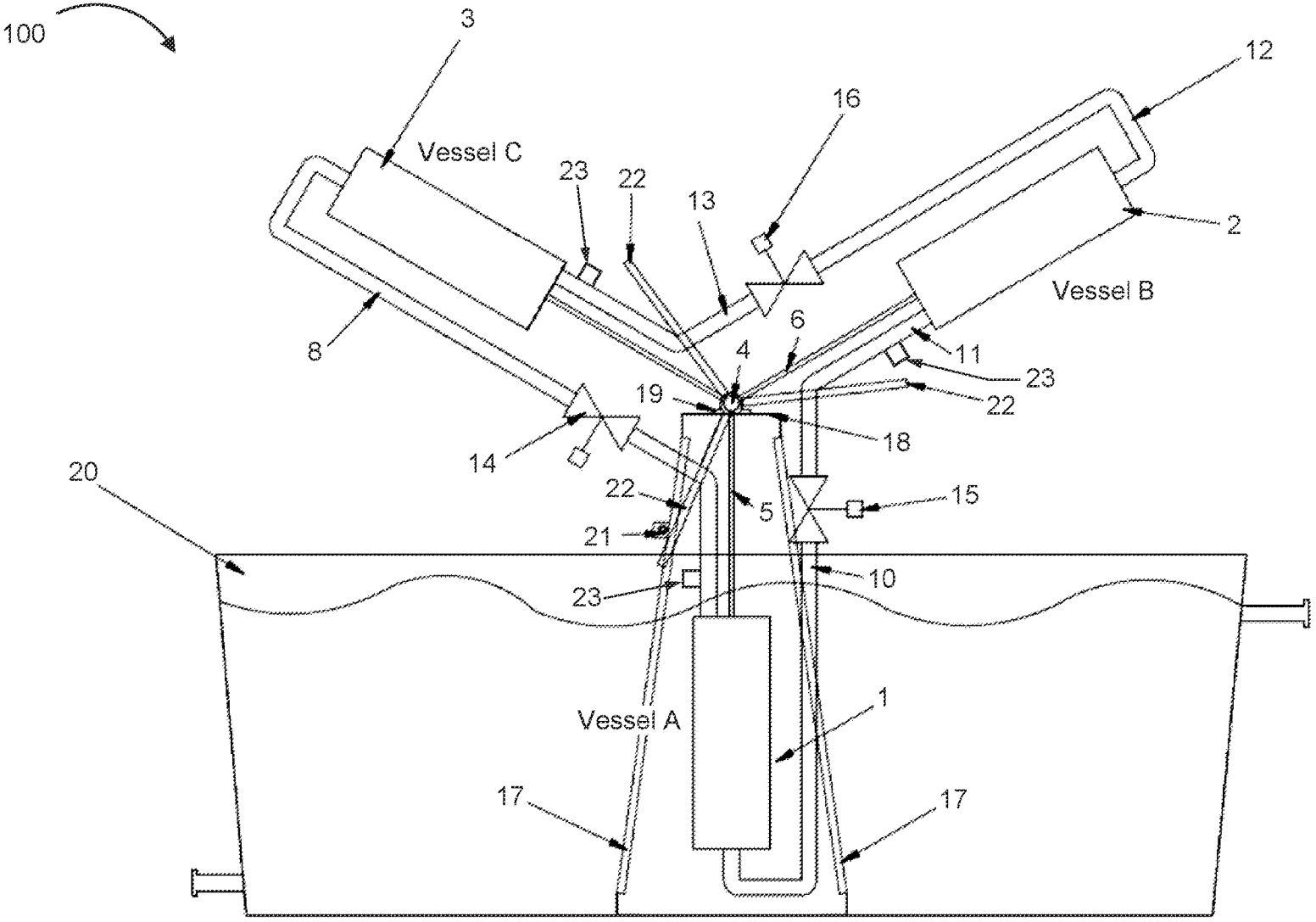
FIG. 1*a* illustrates a front view of an example apparatus for expelling heat, according to some embodiments.

It will be readily understood that the components of certain example embodiments, as generally described and illustrated in the figures herein, may be arranged and designed in a wide variety of different configurations. Thus, the following detailed description of some example embodiments of systems, methods, apparatuses, and computer program products for expelling heat is not intended to limit the scope of certain embodiments but is representative of selected example embodiments.

The features, structures, or characteristics of example embodiments described throughout this specification may be combined in any suitable manner in one or more example embodiments. For example, the usage of the phrases "certain embodiments," "some embodiments," or other similar wording, throughout this specification refers to the fact that a particular feature, structure, or characteristic described in connection with an embodiment may be included in at least one embodiment. Thus, appearances of the phrases "in certain embodiments," "in some embodiments," "in other embodiments," or other similar wording, throughout this specification do not necessarily all refer to the same group of embodiments, and the described features, structures, or characteristics may be combined in any suitable manner in one or more example embodiments. In addition, the phrase "set of" refers to a set that includes one or more of the referenced set members. As such, the phrases "set of," "one or more of," and "at least one of," or equivalent phrases, may be used interchangeably. Further, "or" is intended to mean "and/or," unless explicitly stated otherwise.

Additionally, if desired, the different functions or operations discussed below may be performed in a different order and/or concurrently with each other. Furthermore, if desired, one or more of the described functions or operations may be optional or may be combined. As such, the following description should be considered as merely illustrative of the principles and teachings of certain example embodiments, and not in limitation thereof.

The cost of utilizing electrical and mechanical power to expel waste heat from processes, such as HVAC processes, is wasteful. Currently, cooling towers are utilized to transfer waste heat energy into the air utilizing electrically powered fans. The usage of waste heat can be accomplished with complex heat recovery chillers, but the demand for hot water is rarely coincidental with the need to remove heat. Thus, heat expelling systems typically have to have paired systems using fan power or that are based on transferring and using heated water and there is a need for expelling heat without fan power or dependence on a need for heated water.

Some embodiments described herein may provide for expelling heat. For example, certain embodiments may provide an apparatus that comprises a rotating assembly, a support structure, a condenser water tank, and a control system. The apparatus may rotate the rotating assembly such that tanks of the assembly are rotated into and out of the condenser water tank. The rotation may be self-starting and controlled by a control system. The self-starting aspects may allow for utilization of the waste heat to expel the waste heat without the need for fan power, and may allow for harnessing of the rotary motion. The rotary assembly may include at least three vessels and an odd number of vessels. This odd number of vessels, and a valve system connecting the vessels, may facilitate the self-starting. The rotation may be started when a threshold differential pressure is met. In addition, the valve system may be configured such that just two vessels are in fluid connection at a time with refrigerating fluid in each of the vessels. In this way, certain embodiments may provide for expelling waste heat without fan power, or dependence on a need for heated water, thereby simplifying heat expelling systems and reducing or eliminating a need for certain elements typically included in heat expelling systems. In addition, in this way, certain embodiments may provide for extraction of waste heat and conversion of the waste heat into rotary motion.

Figure 1B:
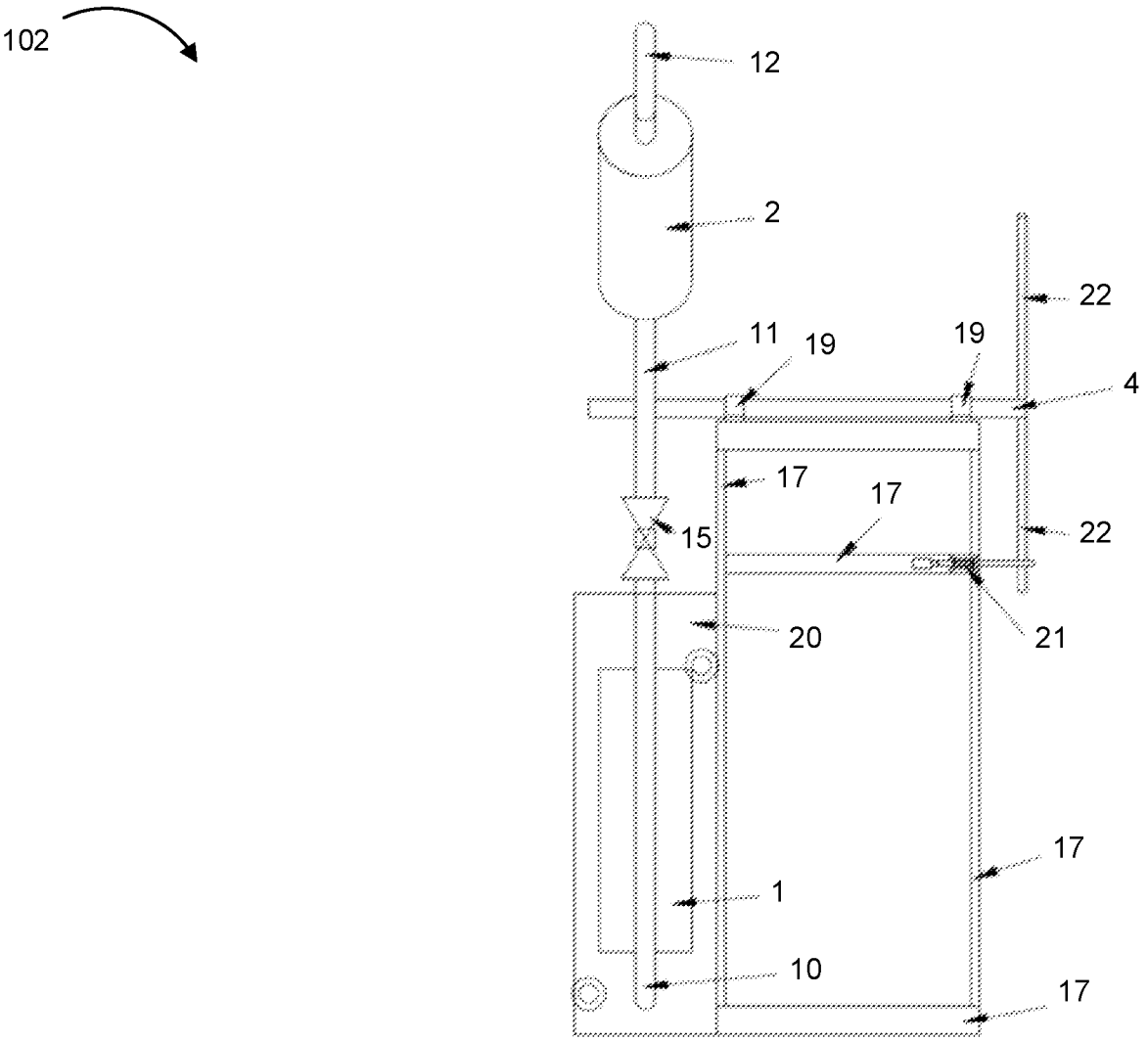
FIG. 1*b* illustrates a side view of the example apparatus for expelling heat, according to some embodiments.
Figure 2A:
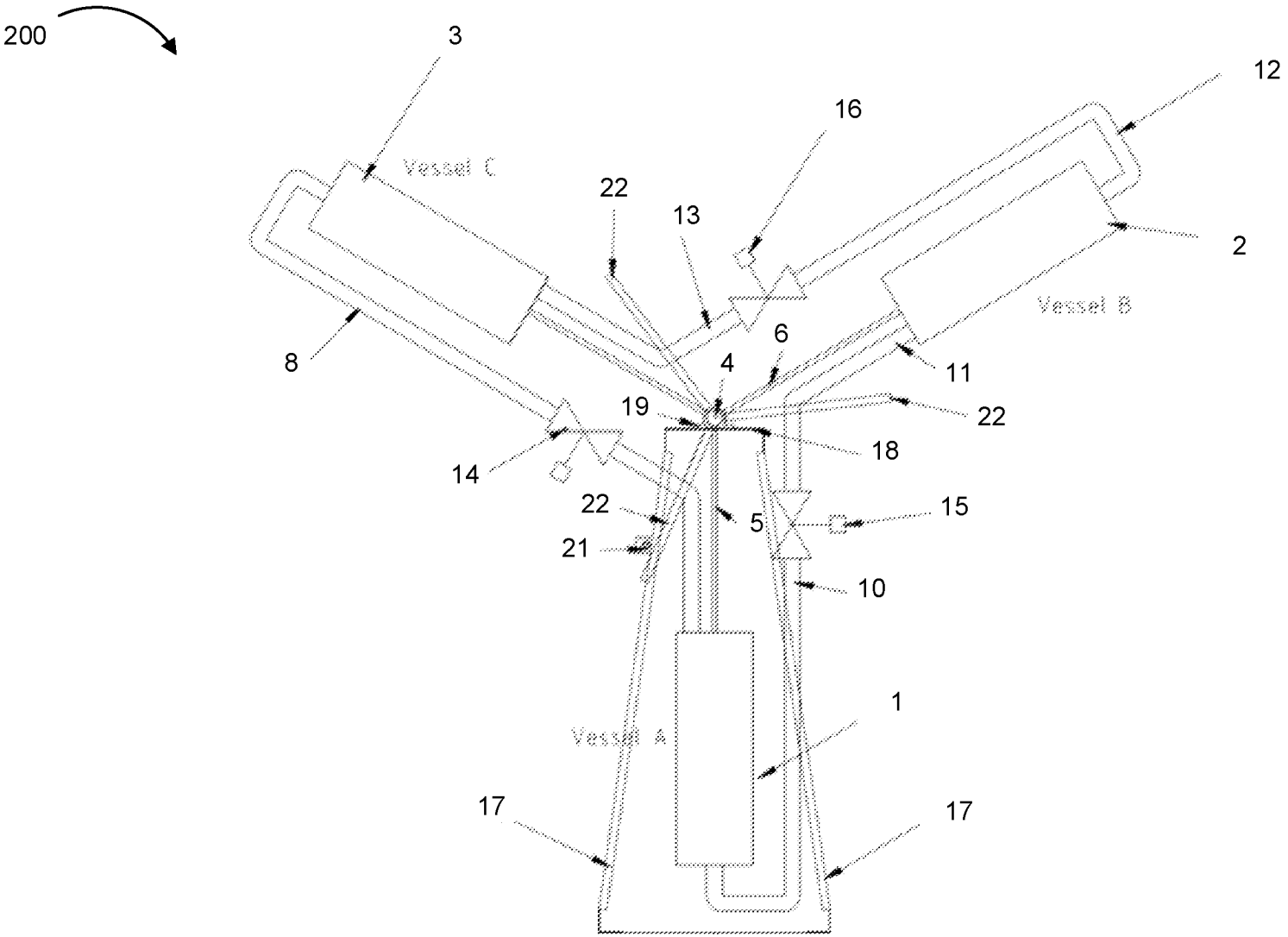
FIG. 2*a* illustrates a front view of a portion of the example apparatus for expelling heat, according to some embodiments.
Figure 2B:
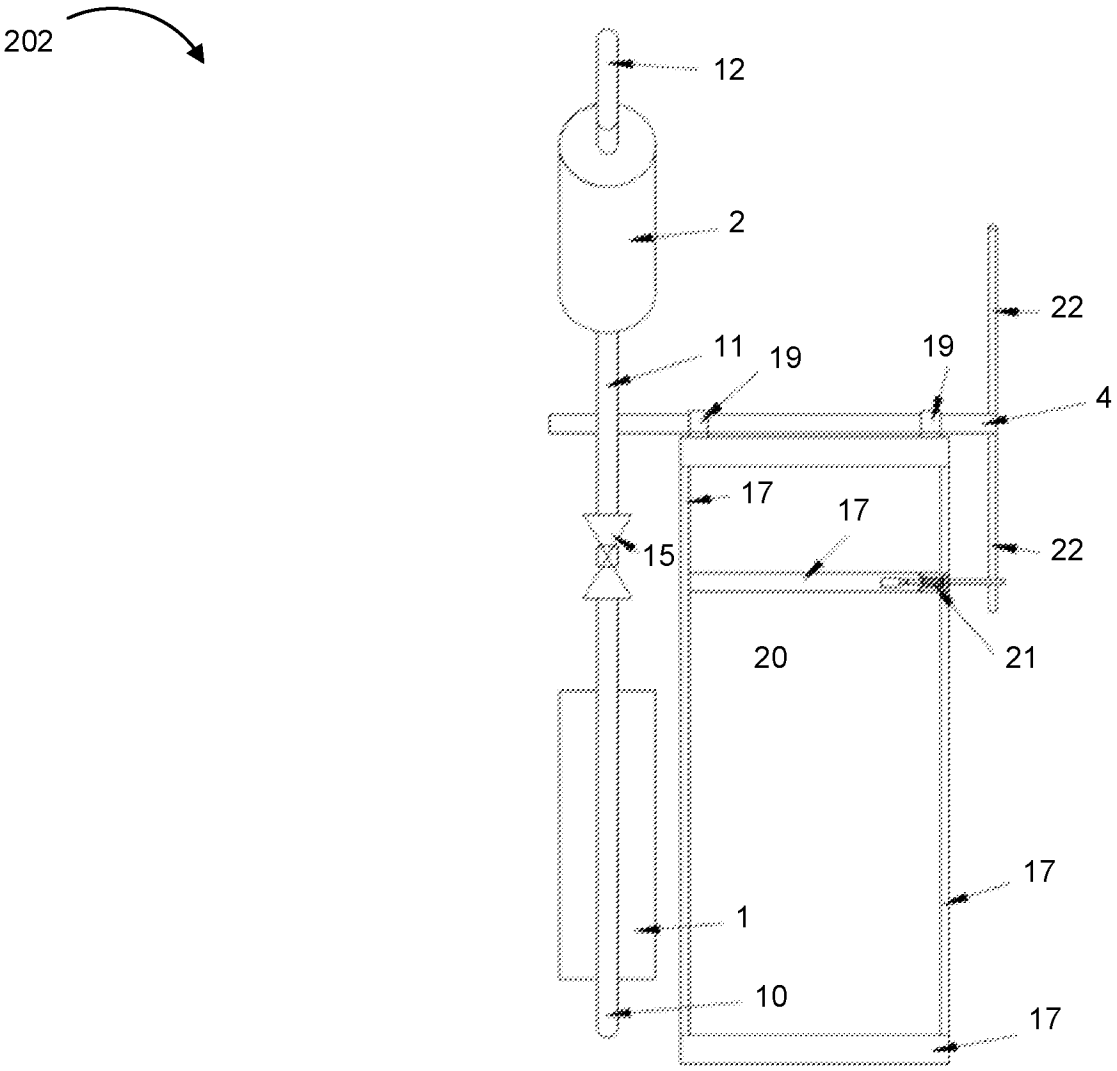
FIG. 2*b* illustrates a side view of the portion of the example apparatus for expelling heat, according to some embodiments.
Figure 3A:
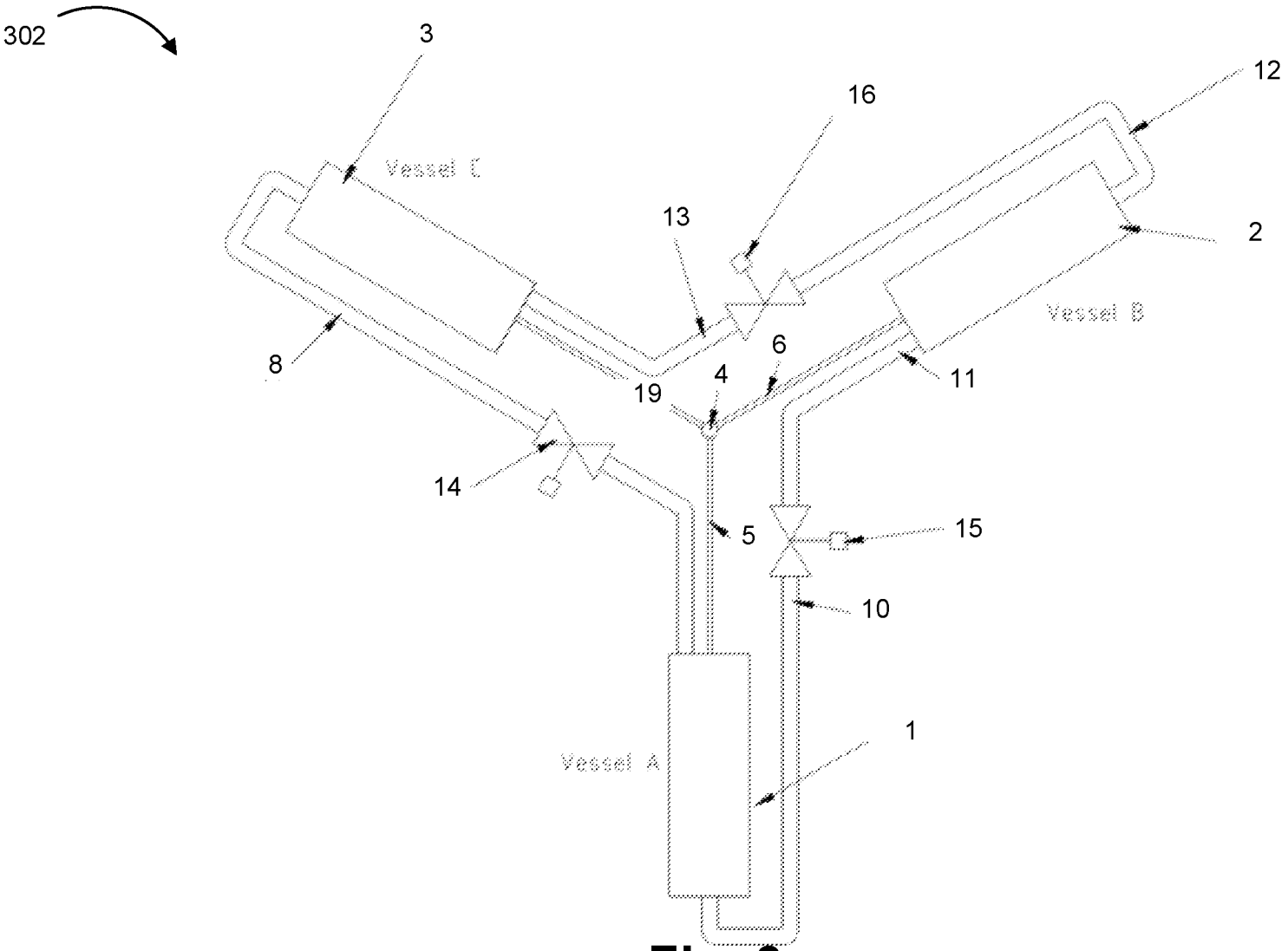
FIG. 3*a* illustrates a front view of another portion of the example apparatus for expelling heat, according to some embodiments.
Figure 3B:
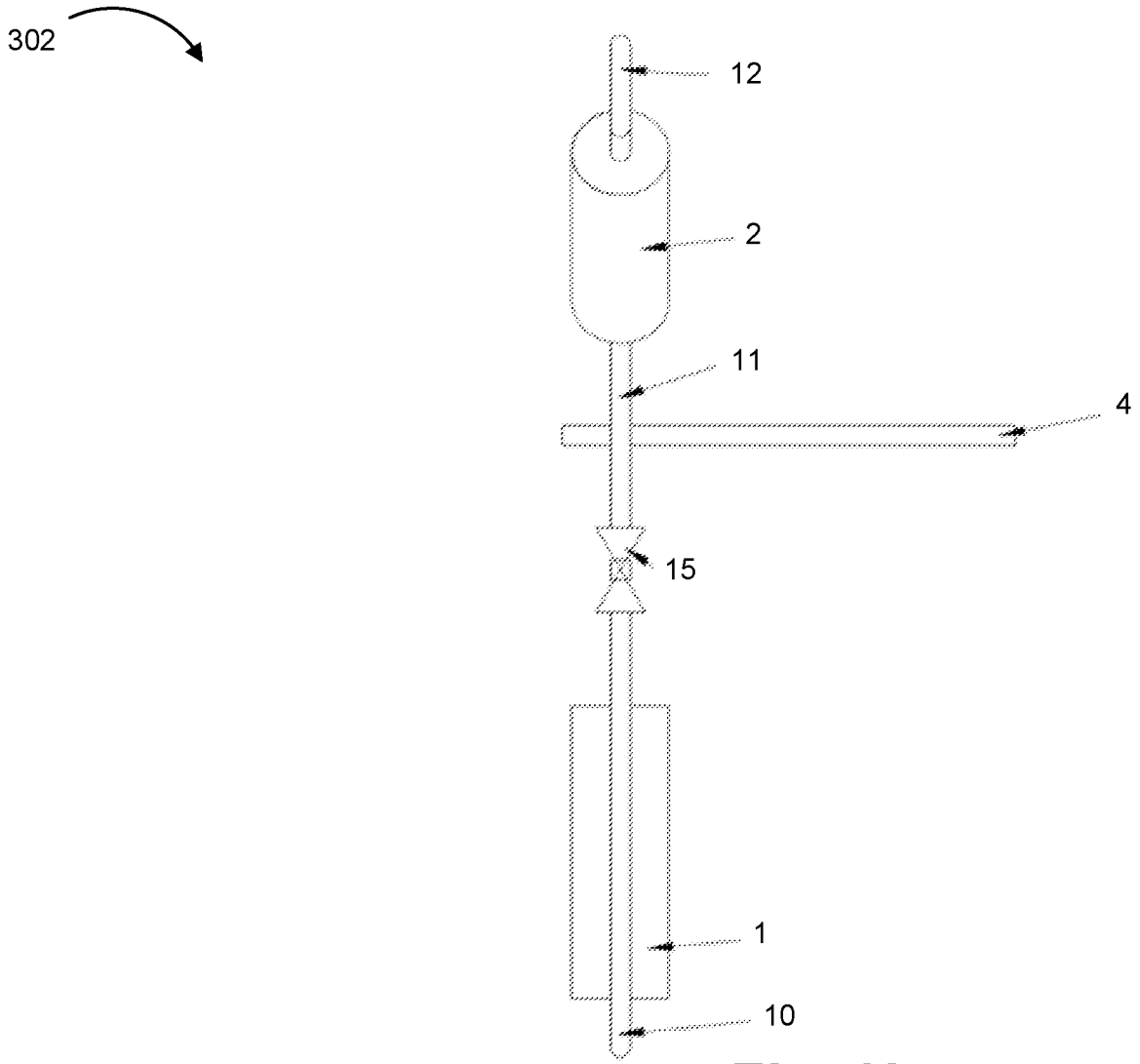
FIG. 3*b* illustrates a side view of the other portion of the example apparatus for expelling heat, according to some embodiments.

FIG. 1*a* illustrates a front view 100 and FIG. 1*b* illustrates a side view 102 of an example apparatus for expelling heat, according to some embodiments. As illustrated in FIGS. 1*a* and 1*b*, the apparatus may comprise a rotary assembly that includes vessels 1, 2, and 3, central shaft 4, arms 5, 6, and 7, piping 8, 9, 10, 11, 12, and 13, and valves 14, 15, and 16.

The rotary assembly may include central shaft 4, which may be formed from round steel or any other suitable material. The rotary assembly may further include a plurality of arms (e.g., arms 5, 6, and 7). The rotary assembly may include an odd number of arms although the example of FIGS. 1*a* and 1*b* include three arms. The arms may be spaced evenly around central shaft 4 and may extend radially from central shaft 4. The arms may be perpendicular to central shaft 4. In the example illustrated in FIGS. 1*a* and 1*b*, the arms 5, 6, and 7 may be welded to a piece of plate steel (e.g., in a triangle shape for the arms 5, 6, and 7) with a collar mounted to accept the central shaft 4.

As further illustrated in FIGS. 1*a* and 1*b*, the rotary assembly may include a plurality of vessels (e.g., vessels 1, 2, and 3). In certain embodiments, there may be a vessel mounted to each arm. Various shapes and designs of the vessels can be used with certain embodiments if they can withstand the differential pressure and provide acceptable heat transfer. For example, the walls of the vessel may have to be thick enough to handle the pressures imposed on them, but thin enough to not retain heat longer than allowed by the timing of the cycle. As a specific example, a vessel may include a finned aluminum-bodied vessel with [3/16"] thick walls.

The piping may include first piping 9, 11, and 13 and second piping 8, 10, and 12. The first piping 9, 11, and 13 may connect one end of vessels 1, 2, and 3, respectively to valves 14, 15, and 16. For example, vessel 1 is illustrated in a "6 o'clock" position, and first piping 9 may connect the high point of vessel 1 to the lower end of valve 14. The second piping 10, 12, and 8 may connect the other end of the vessels 1, 2, and 3, respectively, to valves 15, 16, and 14, respectively. For example, vessel 1 is illustrated in a "6 o'clock" position, and second piping 10 may connect the low point of vessel 1 to the lower end of valve 15. In this way, the rotary assembly may include piping between the low point of a vessel when the vessel is in the "6 o'clock" position and the selected higher fluid entry point on the adjacent vessel. The piping may be sized to provide ample flow to allow the rotational speed desired for the rotating assembly when at certain temperatures. The piping may be pressure tight, and may be free of leaks. The vessels and piping may be filled with a refrigerant, or other working fluid. For example, the refrigerant may be R-123a in some embodiments. The volume of refrigerant used may vary by volume of the vessels and/or piping, the temperature range of the application in which the apparatus is to be used, and/or the like.

Various designs of valves 14, 15, and 16 may be included in certain embodiments. For example, valves 14, 15, and 16 may include electrically actuated ball valves with a spring return. The rotary assembly may include one or more taps 23 in the piping 8, 9, 10, 11, 12, and/or 13. For example, certain embodiments may include at least one tap between adjacent vessels. As described below, the taps may be used by a control system.

The apparatus may further include a support structure that includes base 17, flat portion 18, bearings 19, and slip ring holder 20 and spring-loaded pull-type solenoid 21. Base 17 may provide sufficient mechanical support and weight to hold firm the rotary assembly as it rotates. Base 17 may include a tripod, a vertical surface mount, a base mount, etc. Base 17 may further include a rotation limiting device, a control panel for controlling the apparatus (e.g., one or more buttons, knobs, rotary dials, touchscreens, graphic displays, etc.), and a control system for controlling the rotation of the assembly. Base 17 may be configured to accurately position the rotating assembly such that a particular portion of the vessels 1, 2, and 3 rotate into and out of a condenser water source, illustrated in this example as condenser water tank 20. A portion of base 17 (e.g., flat portion 18) may provide mechanical support for bearings 19. Bearings 19 may allow the rotary movement of central shaft 4. Various types of bearings may be used for bearings 19 and, in some embodiments, bearings 19 may include pillow block bearings. Base 17 may further include a slip ring holder to connect the center axis of a slip ring electrical connector to a similar axis as the central shaft 4 of the rotating assembly.

In this example, the apparatus may further include condenser water tank 20 as the condenser water source. The condenser water tank 20 may include an open-topped vessel of sufficient size to allow the water heated by an external process (e.g., an HVAC condenser water, industrial coolant, etc.) to interact with the rotating assembly and not impede rotation of the rotating assembly. The shape and size of tank 20 may be dependent on the application and may be of sufficient size to allow the rotating assembly to be sufficiently submerged for the proper amount of heat exchange needed for the cooling application design temperatures. This can be direct interaction in an open system; In other embodiments, the condenser water source could be linked to condenser water with a separate or incorporated heat exchanger; such a configuration could provide a closed loop system instead of an open loop system. The tank 20 may comprise various materials suitable for the application. For example, the tank 20 may comprise a galvanized metal.

Furthermore, the apparatus may include rods 22 attached to central shaft 4. For example, the number of rods may be equal to the number of arms attached to central shaft 4 and the rods 22 may be attached in a similar manner. The rods 22 may interact mechanically with solenoid 21. For example, there may be a disc located on the rear of central shaft 4 along with a pull type solenoid 21 that may lock central shaft 4 into one of a number of positions (e.g., the number of positions may be equal to the number of vessels), using a spring-loaded pull solenoid 21.

As described above, FIGS. 1*a* and 1*b* are provided as examples. Other examples are possible, according to some embodiments. In certain applications the apparatus could be linked to a process cooling system rather than an HVAC application, in which case the water or fluid could be warm or hot water, rather than condenser water.

FIGS. 2*a*, 2*b*, 3*a*, and 3*b* illustrate various views of various portions of the example apparatus for expelling heat, according to some embodiments. For example, these Figs. may illustrate portions of the heat expelling apparatus illustrated in FIGS. 1*a* and 1*b*.

Figure 4:
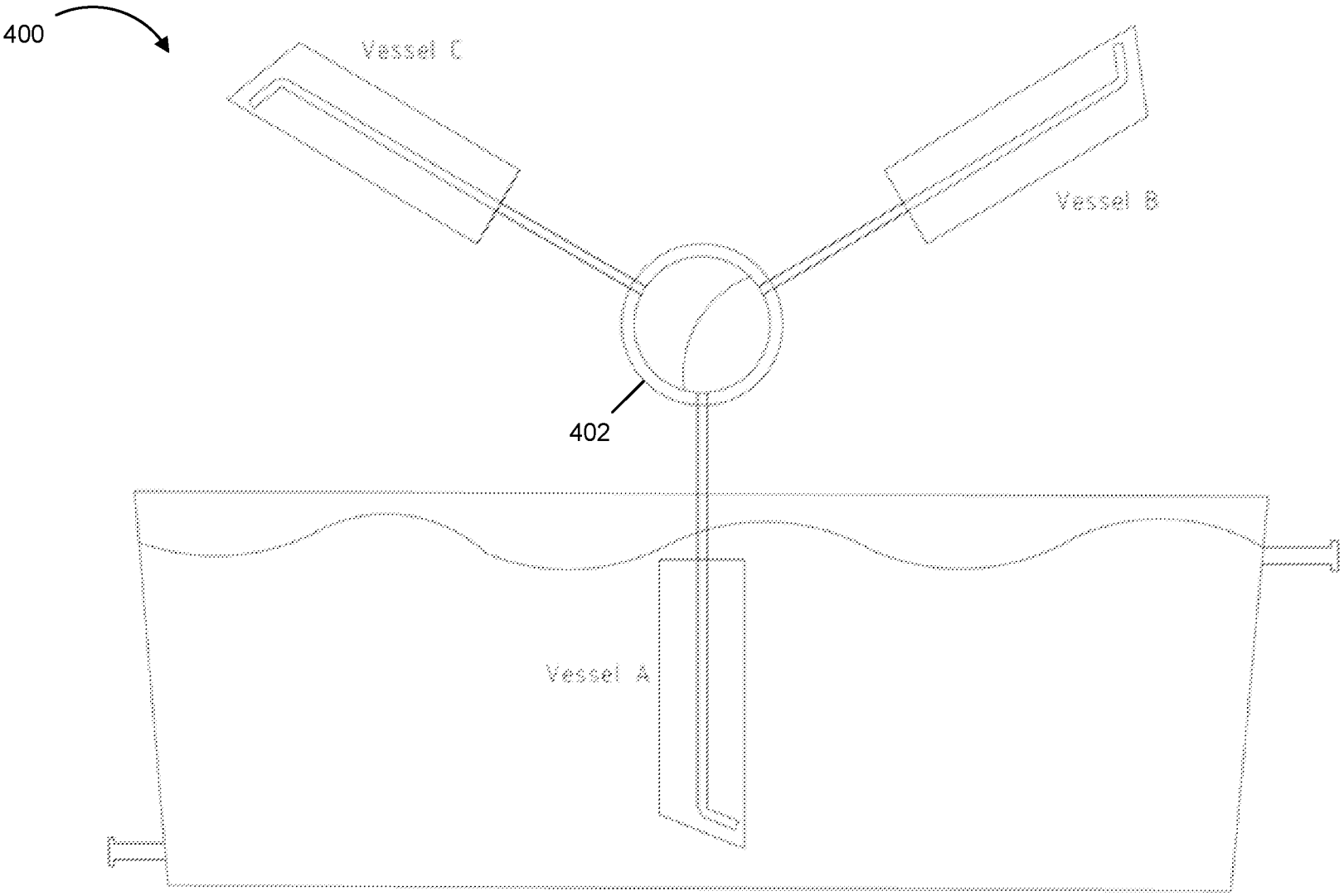
FIG. 4 illustrates a front view of another example of a portion of the apparatus for expelling heat, according to some embodiments.

FIG. 4 illustrates a front view of another example 400 of a portion of the apparatus for expelling heat, according to some embodiments. The example 400 may include a rotary assembly 402. Different than the rotary assembly of FIGS. 1*a*-3*b*, the rotary assembly 402 may include a single central valve. This may allow passage of the refrigerant from the vessel in the bottom of the rotation (e.g., vessel A in FIG. 4) to the next vessel (e.g., vessel B in FIG. 4) without pressure transducers. In addition, loading of the rotational assembly 402 by varying torsional loading may provide governing of the maximum rotational speed to match the ambient temperature versus the cooled fluid temperature entering the tank.

As described above, FIG. 4 is provided as an example. Other examples are possible, according to some embodiments.

Figure 5B:
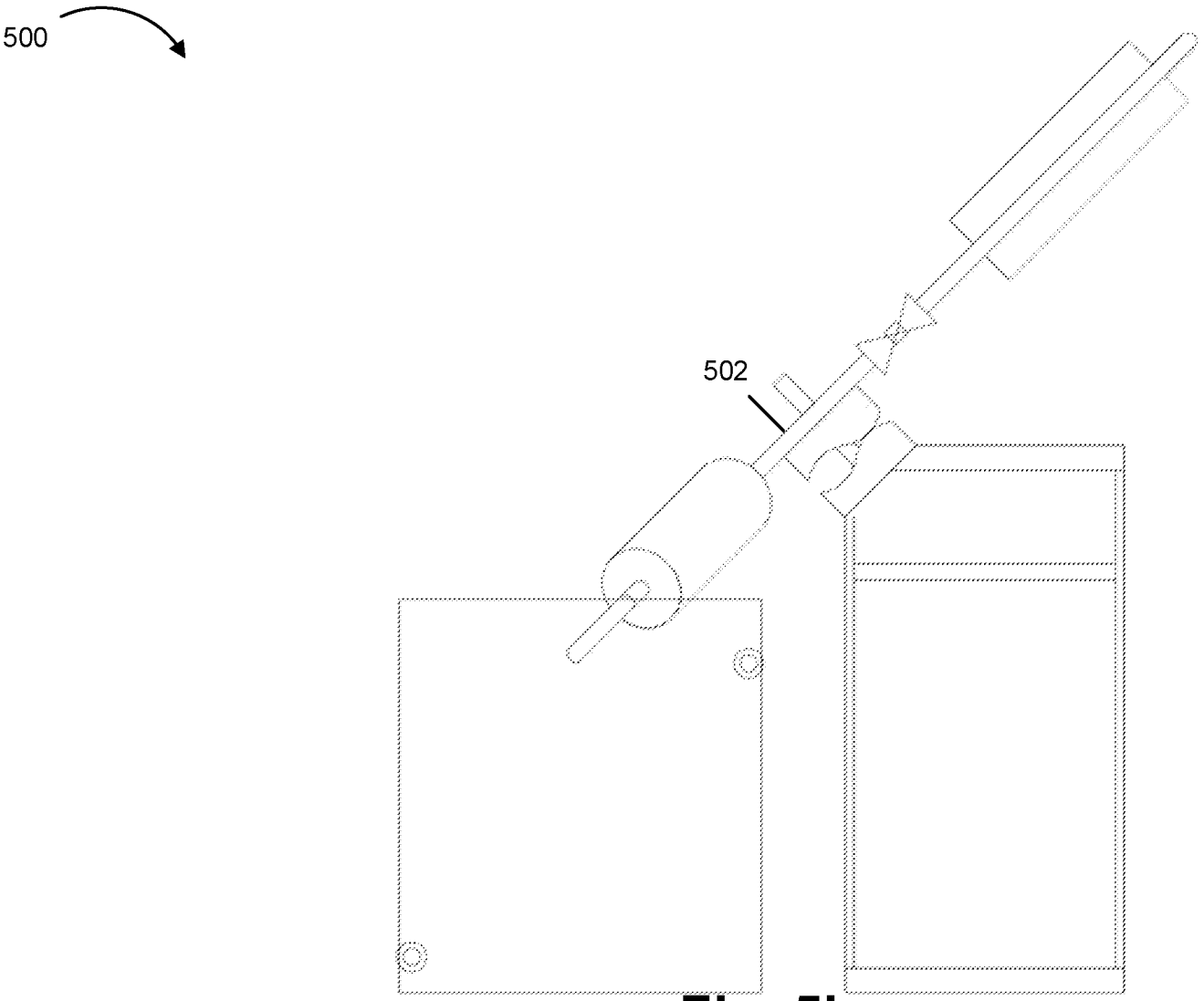
FIG. 5*b* illustrates another side view of the example of the other apparatus for expelling heat, according to some embodiments.

FIGS. 5*a* and 5*b* illustrate side views of an example 500 of another apparatus for expelling heat. As illustrated in FIGS. 5*a* and 5*b*, a rotary assembly 502 may be arranged to shift the rotation of the rotary assembly 502 in to a plane less than perpendicular to the horizon. The axle structure may be altered such that the rotational movement also moves the rotating structure away from the supporting structure and back in intervals corresponding to the number of vessels. For example, the axis of rotation may be between perpendicular to the base and parallel to the base (e.g., at a 45 degree angle to the base). Rotating the rotary plane of the device to be less than 90 degrees from the ground may offer benefits in allowing further cooling of the vessels not in the tank.

As indicated above, FIGS. 5*a* and 5*b* are provided as examples. Other examples are possible, according to some embodiments.

Figure 6:
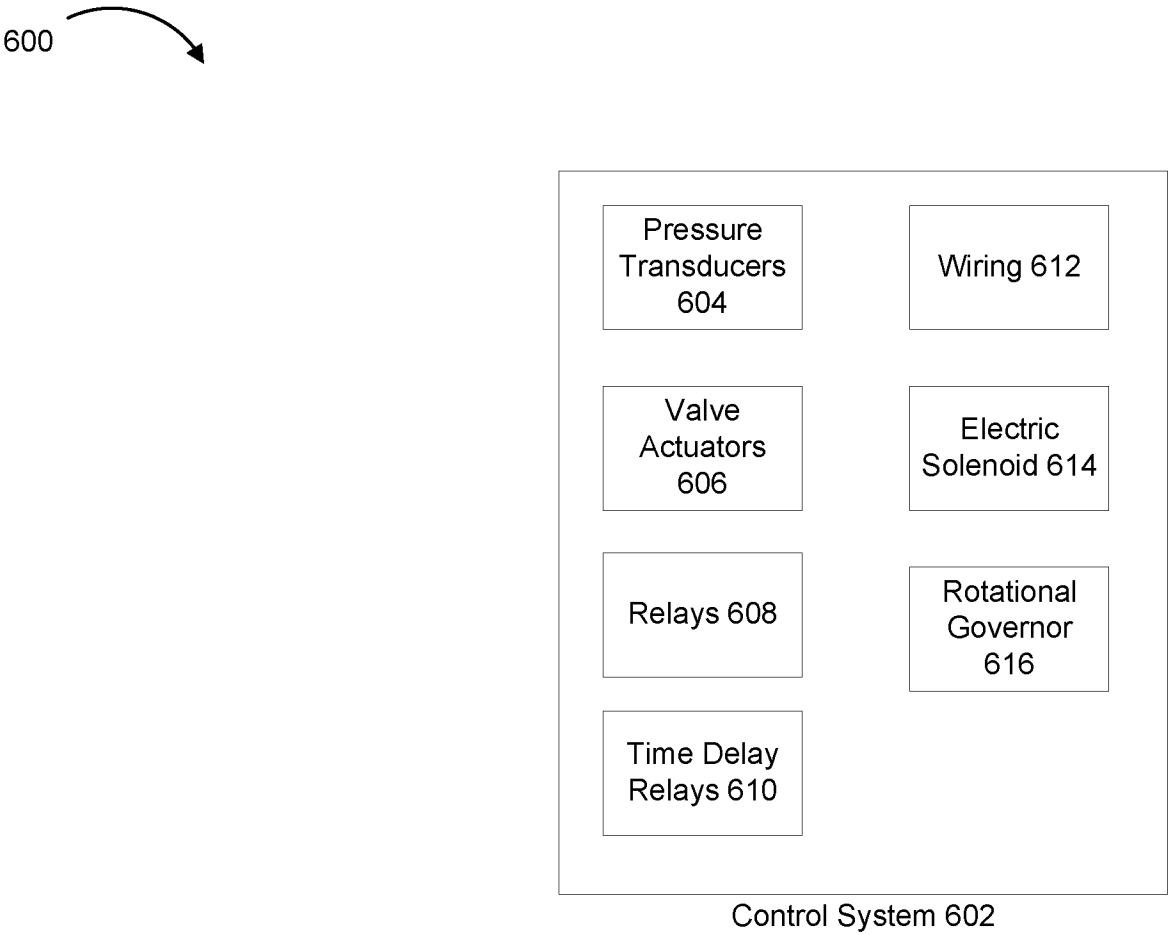
FIG. 6 illustrates an example of a control system, according to some embodiments.

FIG. 6 illustrates an example 600 of a control system 602, according to some embodiments. As illustrated in FIG. 6, the control system 602 may include pressure transducers 604, valve actuators 606, relays 608, time delay relays 610, wiring 612, electric solenoid 614 (e.g., a pull-type electric solenoid), and rotational governor 616. In certain embodiments, the pressure transducers 604 may be positioned at each tap between each adjacent vessel. The rotational governor 616 may include a disc located on the rear of the central shaft with the electric solenoid 614. The rotational governor 616 may lock the central shaft in to one of three positions (e.g., where the number of positions equals the number of vessels). The locking may be performed by, e.g., a spring loaded pull solenoid (e.g., electric solenoid 614) or other suitable means.

As described above, FIG. 6 is provided as an example. Other examples are possible, according to some embodiments.

The apparatus for expelling heat and the control system described herein may operate as follows. Heat may flow in to the tank with entry of heated process water in an open-type system, or via a heat exchanger in a closed loop system. As the heat reaches a sufficient point in the water in the tank and the heat transfers to the refrigerant inside a first vessel (vessel A), the boiling point of the refrigerant at the design system pressure in the first vessel may be reached. A first pressure transducer (p1) may reach a sufficient pressure to close a switch, thereby applying power to a relay that opens a first valve (v1) that is normally closed between the first vessel and a second vessel. Pressure from the expansion of the refrigerant may push the majority of the liquid refrigerant down and through the pipe and valve from the first vessel to the second vessel, which may be at or near ambient temperature. The buoyancy of the now empty vessel coupled with the weight that is now transferred to the second vessel, may provide a rotating assembly with potential energy to rotate, e.g., in a clock-wise direction.

A first time delay relay (r1) (which may be adjusted based on refrigerant pressures and charge, ambient conditions, vessel sizing, pipe sizing, valve flow capacity and design process water temperature) may end, and the relay may interrupt power to the first valve actuator (v1), thereby closing the valve and providing voltage output to a second time delay relay (r2), which may apply power to a solenoid in the rotational governor allowing, e.g., clockwise rotation to occur. The second timing interval in the relay (r2) may lapse as the rotating assembly rotates 120 degrees, and the solenoid may engage the next opening in the disk portion of the rotational governor wheel, thereby halting the rotation with the second vessel in the "six o'clock" position. The timing of this relay may also be adjusted based on refrigerant pressures, ambient conditions, vessel sizing, pipe sizing, valve flow capacity and design process water temperature.

If the heat maintains a sufficient point in the water in the tank and the heat transfers to the refrigerant inside the second vessel, the boiling point of the refrigerant at the design system pressure in the second vessel may be reached. A second pressure transducer (p2) may reach a sufficient pressure to close the switch, thereby applying power to the relay that opens a second valve (v2) that is normally closed between the second vessel and a third vessel (vessel C). Pressure from the expansion of the refrigerant may push the majority of the liquid refrigerant down and through the pipe and valve from the second vessel to the third vessel, which may be at or near ambient temperature. The buoyancy of the now empty vessel coupled with the weight that is now transferred to the third vessel may provide the rotating assembly potential energy to rotate, e.g., clock-wise. A third time delay relay (r3) (which may be adjusted based on refrigerant pressures and charge, ambient conditions, vessel sizing, pipe sizing, valve flow capacity and design process water temperature) may end, and the relay may interrupt power to the second valve actuator (v2), thereby closing the valve and providing voltage output to a fourth time delay relay (r4) which may apply power to the solenoid in the rotational governor allowing, e.g., clockwise rotation to occur.

The timing interval in the fourth relay (r4) may lapse as the rotating assembly rotates 120 degrees, and the solenoid may engage the next opening in the disk portion of the rotational governor wheel, thereby halting the rotation with the second vessel in the "six o'clock" position. The timing of this relay may also be adjusted based on refrigerant pressures, ambient conditions, vessel sizing, pipe sizing, valve flow capacity and design process water temperature.

If the heat maintains a sufficient point in the water in the tank and the heat transfers to the refrigerant inside the third vessel, the boiling point of the refrigerant at the design system pressure in the third vessel may be reached. The third pressure transducer (p3) may reach a sufficient pressure to close the switch, thereby applying power to the relay that opens the third valve (v3) that is normally closed between the third vessel and the fourth vessel.

Pressure from the expansion of the refrigerant may push the majority of the liquid refrigerant down and through the pipe and valve from the third vessel to the first vessel, which may be at or near ambient temperature, and may be below ambient temperature due to the moisture carried over from its initial position in the water, depending on speed of the cycle. The buoyancy of the now empty vessel coupled with the weight that is now transferred to the first vessel may provide the rotating assembly potential energy to rotate, e.g., clock-wise. A fifth time delay relay (r5) (which may be adjusted based on refrigerant pressures and charge, ambient conditions, vessel sizing, pipe sizing, valve flow capacity and design process water temperature) may end, and the relay may interrupt power to the third valve actuator (v3), thereby closing the valve and provides voltage output to a sixth time delay relay (r6) which may apply power to the solenoid in the rotational governor allowing, e.g., clockwise rotation to occur.

The timing interval in the sixth relay (r6) may lapse as the rotating assembly rotates 120 degrees, and the solenoid may engage the next opening in the disk portion of the rotational governor wheel, thereby halting the rotation with first vessel in the "six o'clock" position. The timing of this relay may also be adjusted based on refrigerant pressures, ambient conditions, vessel sizing, pipe sizing, valve flow capacity and design process water temperature. The process described above may continue as long as sufficient heat input is provided to the water tank.

The above description of certain embodiments is illustrative only, and numerous changes and modifications can be made that would remain within the spirit and scope of the invention. For example, the number of vessels could be easily variable, and a three vessel series as discussed above is illustrative only. In addition, the materials and shapes of the vessels may vary. The vessels may be configured as both the vessels and radial arms, negating the need for separate radial arms. The arrestor may be eliminated with a matching resistance torsional load from a generator. An arrestor or governor may include a disc or drum brake or a stepped field generator assembly and/or the like. The valve system may be varied to utilize any variety of valve types. The valve controls may include a variety of different sequences involving a Programmable Logic Controller or bulb type Thermostatic eXpansion Valves in lieu of the relay system described herein.

One of the many possible valve systems illustrated and discussed herein may incorporate a portion of the control system by utilizing a central hub with passages from one vessel to the next that may allow flow when the vessels are in the appropriate position. The refrigerant or fluid utilized in the process in the vessels may be varied, but certain embodiments may use R-123a due to its specific gravity. Certain embodiments may include a reservoir on the vessels exterior to take some of the water from the tank as the vessels rise from the water, and the water may be poured from the tank down one side of the vessel as it rises past the "nine o'clock" position, thereby providing evaporative cooling added to the system. Certain embodiments described herein may be utilized in a variety of contexts, such as HVAC application, or a reduced scale version of the heat expelling apparatus may be utilized in lower room temperatures indoors to cool a heat transfer grid in a pillow, thereby providing cooling to the user's head and a white noise created by the rotating mechanism's rotation.

In certain embodiments, an apparatus described herein may include a computing device. For example, the control system may include a computing device to control rotation of a rotary assembly, to gather metrics such as rotational speed, water temperature, etc. related to use of the apparatus, and/or the like.

Figure 7:
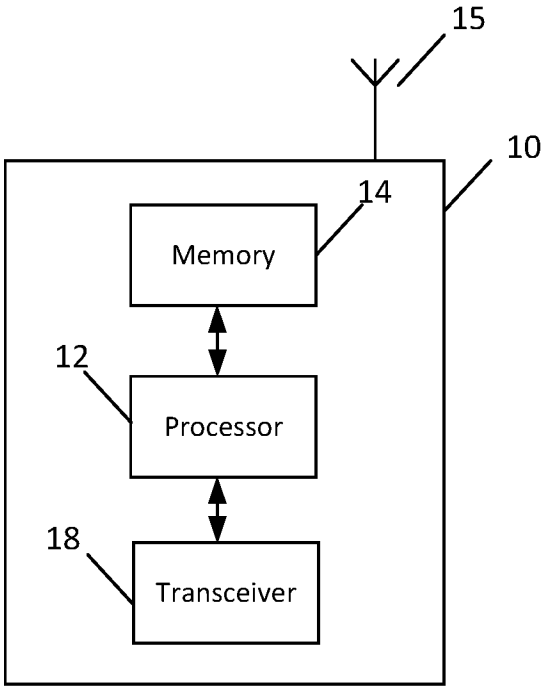
FIG. 7 illustrates an example block diagram of an apparatus, according to an embodiment.

FIG. 7 illustrates an example of an apparatus 10 according to an embodiment. In an embodiment, apparatus 10 may be a computing device (e.g., a computing device associated with a control system), and/or the like. One or more apparatuses 10 may be connected via a wired network, a wireless network, or a combination of wired and wireless networks.

As illustrated in the example of FIG. 7, apparatus 10 may include a processor 12 for processing information and executing instructions or operations. Processor 12 may be any type of general or specific purpose processor. In fact, processor 12 may include one or more of general-purpose computers, special purpose computers, microprocessors, digital signal processors (DSPs), field-programmable gate arrays (FPGAs), application-specific integrated circuits (ASICs), and processors based on a multi-core processor architecture, as examples. While a single processor 12 is shown in FIG. 7, multiple processors may be utilized according to other embodiments. For example, it should be understood that, in certain embodiments, apparatus 10 may include two or more processors that may form a multiprocessor system (e.g., in this case processor 12 may represent a multiprocessor) that may support multiprocessing. In certain embodiments, the multiprocessor system may be tightly coupled or loosely coupled (e.g., to form a computer cluster).

Processor 12 may perform functions associated with the operation of apparatus 10, which may include, for example, precoding of antenna gain/phase parameters, encoding and decoding of individual bits forming a communication message, formatting of information, and overall control of the apparatus 10, including processes related to management of communication or communication resources.

Apparatus 10 may further include or be coupled to a memory 14 (internal or external), which may be coupled to processor 12, for storing information and instructions that may be executed by processor 12. Memory 14 may be one or more memories and of any type suitable to the local application environment, and may be implemented using any suitable volatile or nonvolatile data storage technology such as a semiconductor-based memory device, a magnetic memory device and system, an optical memory device and system, fixed memory, and/or removable memory. For example, memory 14 can be comprised of any combination of random access memory (RAM), read only memory (ROM), static storage such as a magnetic or optical disk, hard disk drive (HDD), or any other type of non-transitory machine or computer readable media. The instructions stored in memory 14 may include program instructions or computer program code that, when executed by processor 12, enable the apparatus 10 to perform tasks as described herein.

In an embodiment, apparatus 10 may further include or be coupled to (internal or external) a drive or port that is configured to accept and read an external computer readable storage medium, such as an optical disc, USB drive, flash drive, or any other storage medium. For example, the external computer readable storage medium may store a computer program or software for execution by processor 12 and/or apparatus 10.

In some embodiments, apparatus 10 may also include or be coupled to one or more antennas 15 for transmitting and receiving signals and/or data to and from apparatus 10. Apparatus 10 may further include or be coupled to a transceiver 18 configured to transmit and receive information. The transceiver 18 may include, for example, a plurality of radio interfaces that may be coupled to the antenna(s) 15. The radio interfaces may correspond to a plurality of radio access technologies including one or more of GSM, NB-IoT, LTE, 5G, WLAN, Bluetooth, BT-LE, NFC, radio frequency identifier (RFID), ultrawideband (UWB), MulteFire, and the like. The radio interface may include components, such as filters, converters (for example, digital-to-analog converters and the like), mappers, a Fast Fourier Transform (FFT) module, and the like, to generate symbols for a transmission via one or more downlinks and to receive symbols (for example, via an uplink).

As such, transceiver 18 may be configured to modulate information on to a carrier waveform for transmission by the antenna(s) 15 and demodulate information received via the antenna(s) 15 for further processing by other elements of apparatus 10. In other embodiments, transceiver 18 may be capable of transmitting and receiving signals or data directly. Additionally or alternatively, in some embodiments, apparatus 10 may include an input and/or output device (I/O device).

In an embodiment, memory 14 may store software modules that provide functionality when executed by processor 12. The modules may include, for example, an operating system that provides operating system functionality for apparatus 10. The memory may also store one or more functional modules, such as an application or program, to provide additional functionality for apparatus 10. The components of apparatus 10 may be implemented in hardware, or as any suitable combination of hardware and software.

According to some embodiments, processor 12 and memory 14 may be included in or may form a part of processing circuitry or control circuitry. In addition, in some embodiments, transceiver 18 may be included in or may form a part of transceiver circuitry.

As used herein, the term "circuitry" may refer to hardware-only circuitry implementations (e.g., analog and/or digital circuitry), combinations of hardware circuits and software, combinations of analog and/or digital hardware circuits with software/firmware, any portions of hardware processor(s) with software (including digital signal processors) that work together to cause an apparatus (e.g., apparatus 10) to perform various functions, and/or hardware circuit(s) and/or processor(s), or portions thereof, that use software for operation but where the software may not be present when it is not needed for operation. As a further example, as used herein, the term "circuitry" may also cover an implementation of merely a hardware circuit or processor (or multiple processors), or portion of a hardware circuit or processor, and its accompanying software and/or firmware. The term circuitry may also cover, for example, a baseband integrated circuit in a server, cellular network node or device, or other computing or network device.

As introduced above, in certain embodiments, apparatus 10 may be a computing device of a control system, or the control system itself.

According to certain embodiments, apparatus 10 may be controlled by memory 14 and processor 12 to perform the functions associated with any of the embodiments described herein, such as some operations illustrated in, or described with respect to, FIGS. 1*a*-7.

In some embodiments, an apparatus (e.g., apparatus 10) may include means for performing a method or any of the variants discussed herein. Examples of the means may include one or more processors, memory, and/or computer program code for causing the performance of the operation.

Therefore, certain example embodiments provide several technological improvements, enhancements, and/or advantages over existing technological processes. For example, one benefit of some example embodiments is a self-starting rotating valve system without the need for fan power or dependence on a need for heated water.

In some example embodiments, the functionality of any of the methods, processes, signaling diagrams, algorithms or flow charts described herein may be implemented by software and/or computer program code or portions of code stored in memory or other computer readable or tangible media, and executed by a processor.

In some example embodiments, an apparatus may be included or be associated with at least one software application, module, unit or entity configured as arithmetic operation(s), or as a program or portions of it (including an added or updated software routine), executed by at least one operation processor. Programs, also called program products or computer programs, including software routines, applets and macros, may be stored in any apparatus-readable data storage medium and may include program instructions to perform particular tasks.

A computer program product may include one or more computer-executable components which, when the program is run, are configured to carry out some example embodiments. The one or more computer-executable components may be at least one software code or portions of code. Modifications and configurations used for implementing functionality of an example embodiment may be performed as routine(s), which may be implemented as added or updated software routine(s). In one example, software routine(s) may be downloaded into the apparatus.

As an example, software or a computer program code or portions of code may be in a source code form, object code form, or in some intermediate form, and it may be stored in some sort of carrier, distribution medium, or computer readable medium, which may be any entity or device capable of carrying the program. Such carriers may include a record medium, computer memory, read-only memory, photoelectrical and/or electrical carrier signal, telecommunications signal, and/or software distribution package, for example. Depending on the processing power needed, the computer program may be executed in a single electronic digital computer or it may be distributed amongst a number of computers. The computer readable medium or computer readable storage medium may be a non-transitory medium.

In other example embodiments, the functionality may be performed by hardware or circuitry included in an apparatus (e.g., apparatus 10 or apparatus 20), for example through the use of an application specific integrated circuit (ASIC), a programmable gate array (PGA), a field programmable gate array (FPGA), or any other combination of hardware and software. In yet another example embodiment, the functionality may be implemented as a signal, such as a non-tangible means that can be carried by an electromagnetic signal downloaded from the Internet or other network.

According to an example embodiment, an apparatus, such as a node, device, or a corresponding component, may be configured as circuitry, a computer or a microprocessor, such as single-chip computer element, or as a chipset, which may include at least a memory for providing storage capacity used for arithmetic operation(s) and/or an operation processor for executing the arithmetic operation(s).

Example embodiments described herein apply equally to both singular and plural implementations, regardless of whether singular or plural wording is used in connection with describing certain embodiments. For example, an embodiment that describes operations of a single computing device equally applies to embodiments that include multiple instances of the computing device, and vice versa.

One having ordinary skill in the art will readily understand that the example embodiments as discussed above may be practiced with operations in a different order, and/or with hardware elements in configurations which are different than those which are disclosed. Therefore, although some embodiments have been described based upon these example embodiments, it would be apparent to those of skill in the art that certain modifications, variations, and alternative constructions would be apparent, while remaining within the spirit and scope of example embodiments.

I claim:

1. An apparatus, comprising:

a central shaft comprising a first end and a second end;

a plurality of arms each comprising a first end and a second end, wherein the first end of each of the plurality of arms is connected to the first end of the central shaft, wherein each of the plurality of the arms extends radially about the first end of the central shaft perpendicular to the first end of the central shaft, wherein the plurality of the arms are spaced evenly about the first end of the central shaft, wherein the plurality of arms comprises an odd number of arms and at least three arms;

a plurality of vessels each comprising a first end and a second end, wherein the first end of the each of the plurality of the vessels is connected to the second end of a corresponding arm of the plurality of arms;

a plurality of valves disposed radially about the first end of the central shaft between adjacent vessels of the plurality of vessels;

first piping that connects each of the plurality of valves to the first end of one of the adjacent vessels;

second piping that connects the each of the plurality of valves to the second end of another of the adjacent vessels; and a plurality of taps in the first piping and the second piping.

2. The apparatus according to claim 1, further comprising a plurality of pressure transducers associated with the plurality of taps.

3. The apparatus according to claim 1, further comprising refrigerant within the plurality of vessels, the first piping, and the second piping.

4. The apparatus according to claim 3, wherein the refrigerant comprises R-123a refrigerant.

5. The apparatus according to claim 1, wherein the apparatus is mechanically supported by a base.

6. The apparatus according to claim 1, wherein the apparatus is configured to rotate the plurality of vessels into and out of a water tank.

7. The apparatus according to claim 1, wherein a rotation of the apparatus is controlled by a control system.

8. An apparatus, comprising:

a support structure comprising a first end and a second end, wherein the first end is configured to mechanically support a central shaft of a rotary assembly;

an open-topped tank at the second end of the support structure; and the rotary assembly, comprising:

the central shaft comprising a first end and a second end;

a plurality of arms each comprising a first end and a second end, wherein the first end of each of the plurality of arms is connected to the first end of the central shaft, wherein each of the plurality of the arms extends radially about the first end of the central shaft perpendicular to the first end of the central shaft, wherein the plurality of the arms are spaced evenly about the first end of the central shaft, wherein the plurality of arms comprises an odd number of arms and at least three arms;

a plurality of vessels each comprising a first end and a second end, wherein the first end of the each of the plurality of the vessels is connected to the second end of a corresponding arm of the plurality of arms;

a plurality of valves disposed radially about the first end of the central shaft between adjacent vessels of the plurality of vessels;

first piping that connects each of the plurality of valves to the first end of one of the adjacent vessels;

second piping that connects the each of the plurality of valves to the second end of another of the adjacent vessels; and a plurality of taps in the first piping and the second piping, wherein the apparatus is configured to rotate the rotary assembly about an axis through the central shaft.

9. The apparatus according to claim 8, further comprising an electric solenoid in the support structure.

10. The apparatus according to claim 8, wherein the axis is perpendicular to the support structure.

11. The apparatus according to claim 8, wherein the axis is between parallel to the support structure and perpendicular to the support structure.

12. The apparatus according to claim 8, wherein the support structure further comprises a rotational governor.

13. The apparatus according to claim 12, wherein the support structure further comprises a solenoid configured to mechanically interact with the rotational governor to control a positioning of the rotary assembly.

14. The apparatus according to claim 8, wherein the rotary assembly is further configured to rotate the plurality of vessels into and out of the open-topped tank.

15. A system, comprising:

a plurality of pressure transducers at a plurality of taps between adjacent vessels of a rotary assembly, wherein the rotary assembly comprises an odd number of vessels and at least three vessels, wherein the vessels are attached to corresponding arms attached to a central shaft and extending radially from the central shaft, wherein the arms are evenly distributed around the central shaft, wherein the rotary assembly comprises first and second piping to connect adjacent vessels of the rotary assembly;

valve actuators configured to actuate a plurality of valves of the rotary assembly associated with the plurality of taps; and a rotational governor configured to control rotation of the rotary assembly about an axis through the central shaft such that the vessels rotate through an open-topped tank as the rotary assembly is rotated.

16. The system according to claim 15, further comprising an electric solenoid configured to mechanically interact with the rotational governor to control the rotation.

17. The system according to claim 16, wherein the electric solenoid and the rotational governor provide a quantity of positions equal to a quantity of vessels in the plurality of vessels.

18. The system according to claim 15, further comprising a plurality of time delay relays that interrupt power to one or more of the valve actuators to close one or more of the plurality of valves.

19. The system according to claim 15, wherein one or more components of the system are installed in a support structure that mechanically supports the rotary assembly.

20. The system according to claim 15, wherein the system is configured to control a rotation of the rotary assembly.

* * * * *